US008723738B2

(12) United States Patent
Hiraoka

(10) Patent No.: US 8,723,738 B2
(45) Date of Patent: May 13, 2014

(54) MOBILE TERMINAL

(75) Inventor: Yoshiaki Hiraoka, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 452 days.

(21) Appl. No.: 13/072,263

(22) Filed: Mar. 25, 2011

(65) Prior Publication Data

US 2011/0234460 A1 Sep. 29, 2011

(30) Foreign Application Priority Data

Mar. 29, 2010 (JP) ..... 2010-074341

(51) Int. Cl.
*H01Q 1/24* (2006.01)

(52) U.S. Cl.
USPC ..... 343/702; 343/724; 455/575.1; 455/550

(58) Field of Classification Search
USPC ..... 343/702, 724; 455/575.1, 550
See application file for complete search history.

(56) References Cited

FOREIGN PATENT DOCUMENTS

| | | |
|---|---|---|
| JP | 2007-180870 | 7/2007 |
| JP | 2010-045856 A | 2/2010 |

OTHER PUBLICATIONS

Non-Final Rejection dated Jan. 28, 2014 issued by Japanese Patent Office for Japanese Patent Application No. 2010-074341.

*Primary Examiner* — Allyson Trail

(57) ABSTRACT

A mobile terminal includes a first housing, a second housing, and a connection section. A first antenna that resonates at a prescribed wavelength is arranged in the first housing. A first conductive section is arranged in the second housing. The connection section connects the first housing and the second housing so as to transit between an open state, in which the first housing and the second housing are open, and a closed state, in which the first housing and the second housing are closed. The first conductive section includes a first section formed at a length corresponding to the prescribed wavelength, and a high-impedance section that is arranged on the end of the first section and has a higher impedance than the first section.

16 Claims, 8 Drawing Sheets

MOBILE TERMINAL

CROSS-REFERENCE TO RELATED APPLICATION

The present application claims priority under 35 U.S.C. §119 to Japanese Patent Application No. 2010-074341, filed on Mar. 29, 2010, entitled "MOBILE TERMINAL". The content of which is incorporated by reference herein in its entirety.

FIELD

Embodiments of the present disclosure relate generally to mobile terminal comprising an antenna.

BACKGROUND

Mobile terminals, such as mobile phones, comprising: a first housing in which an antenna is arranged; a second housing in which a conductive section is arranged; and a connection section that connects the first housing and the second housing in a manner enabling transitions between an open state, in which the first housing and the second housing are open relative to each other, and a closed state, in which the first housing and the second housing are closed. When the first housing and the second housing are in a closed state, the distance between the antenna and the conductive section decreases compared to the open state. In this case, when the first housing and the second housing are in a closed state, there is a risk that the radiation gains of the antenna deteriorate.

SUMMARY

A mobile terminal comprises a first housing, a second housing, and a connection section. A first antenna that resonates at a prescribed wavelength is arranged in the first housing. A first conductive section is arranged in the second housing. The connection section connects the first housing and the second housing so as to transition between an open state, in which the first housing and the second housing are open, and a closed state, in which the first housing and the second housing are closed. The first conductive section comprises a first section formed at a length corresponding to the prescribed wavelength and a high-impedance section that is arranged on the end of the first section and has a higher impedance than the first section.

BRIEF DESCRIPTION OF THE DRAWINGS

Embodiments of the present disclosure are hereinafter described in conjunction with the following figures, wherein like numerals denote like elements. The figures are provided for illustration and depict exemplary embodiments of the present disclosure. The figures are provided to facilitate understanding of the present disclosure without limiting the breadth, scope, scale, or applicability of the present disclosure. The drawings are not necessarily made to scale.

DETAILED DESCRIPTION

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding field, background, summary or the following detailed description. The present disclosure should be accorded scope consistent with the claims, and not limited to the examples described and shown herein.

Embodiments of the disclosure are described herein in the context of one practical non-limiting application, namely, an information device. Embodiments of the disclosure, however, are not limited to such mobile information devices, and the techniques described herein may also be utilized in other applications. For example, embodiments may be applicable to mobile phones, digital books, digital cameras, electronic game machines, digital music players, personal digital assistance (PDA), personal handy phone system (PHS), lap top computers, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
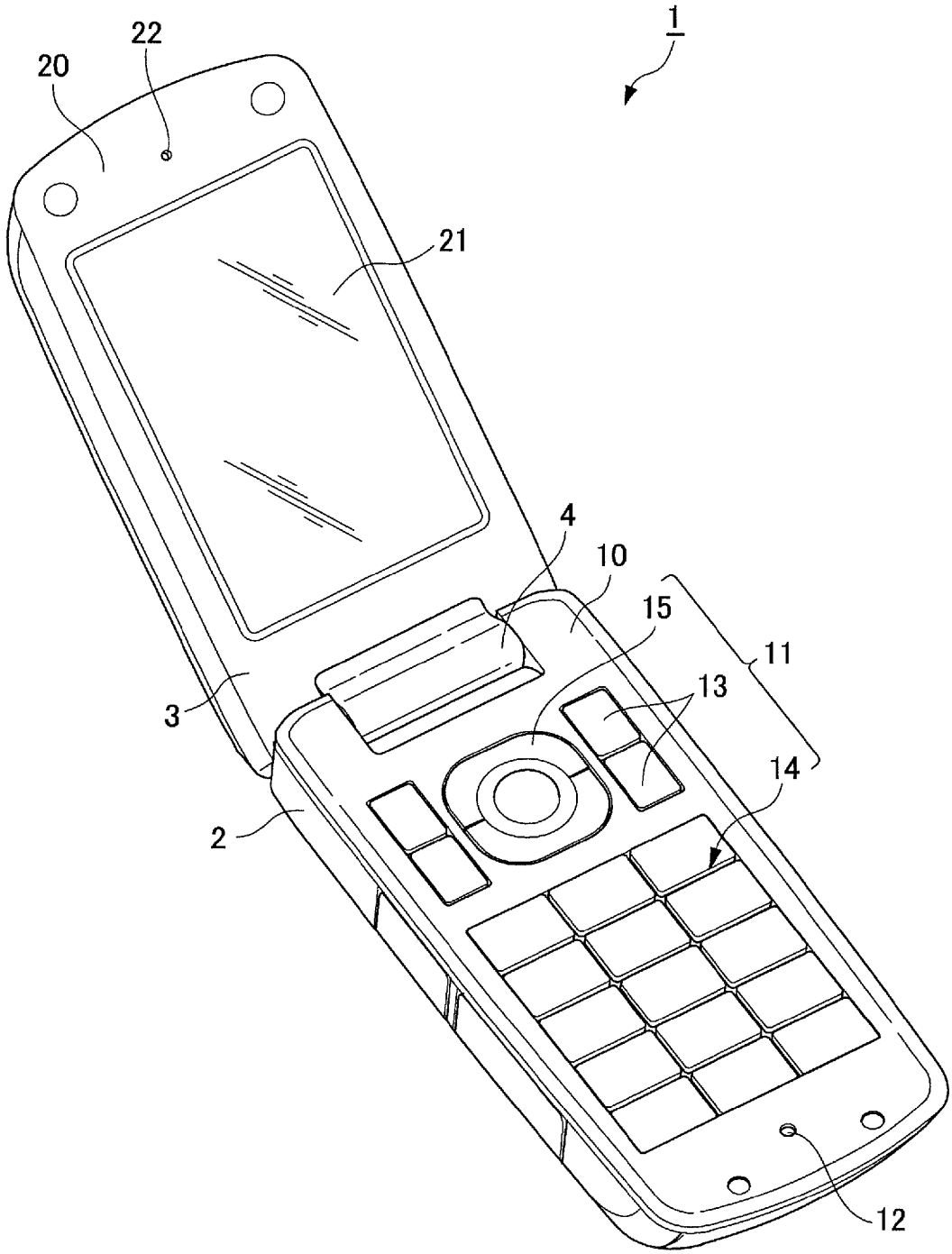
FIG. 1 is an external perspective view of the mobile phone 1.

Preferred embodiments for implementing the present invention will be described with reference to the drawings. The basic structure of a mobile phone 1 according to one embodiment of the mobile terminal of the present invention will be described with reference to FIG. 1. FIG. 1 is an external perspective view of the mobile phone 1 according to one embodiment of a mobile terminal.

The mobile phone 1 comprises: an operation-section-side housing (first housing) 2; a display-section-side housing (second housing) 3; and a connection section 4 that connects the operation-section-side housing 2 and the display-section-side housing 3 in a manner enabling transitions between an open state, in which the operation-section-side housing 2 and the display-section-side housing 3 are open, and a closed state, in which the operation-section-side housing 2 and the display-section-side housing 3 are closed.

The operation-section-side housing 2 comprises an operation section 11 and a microphone 12 on a front surface 10. The front surface 10 of the operation-section-side housing 2 is the surface facing the display-section-side housing 3 when the mobile phone 1 is in a folded state (closed state).

The operation section 11 comprises: a function-setting operation key 13 for activating various setting functions or various functions, such as a dictionary function or an E-mail function; an input operation key 14 for inputting numbers and characters; and a selection operation key 15 for performing selections and scrolling, etc. for various operations.

The microphone 12 is used for inputting audio output by a user of the mobile phone 1 during a call.

The display-section-side housing 3 comprises a display section 21 and a speaker 22 on the front surface 20. The front surface 20 of the display-section-side housing 3 is the surface facing the operation-section-side housing 2 when the mobile phone 1 is in a folded state (closed state).

The display section 21 displays various types of information (character information and image information), such as the phone number and E-mail address of the other party of a call, or the content of an E-mail. The speaker 22 outputs audio from the other party of the call.

Figure 2:
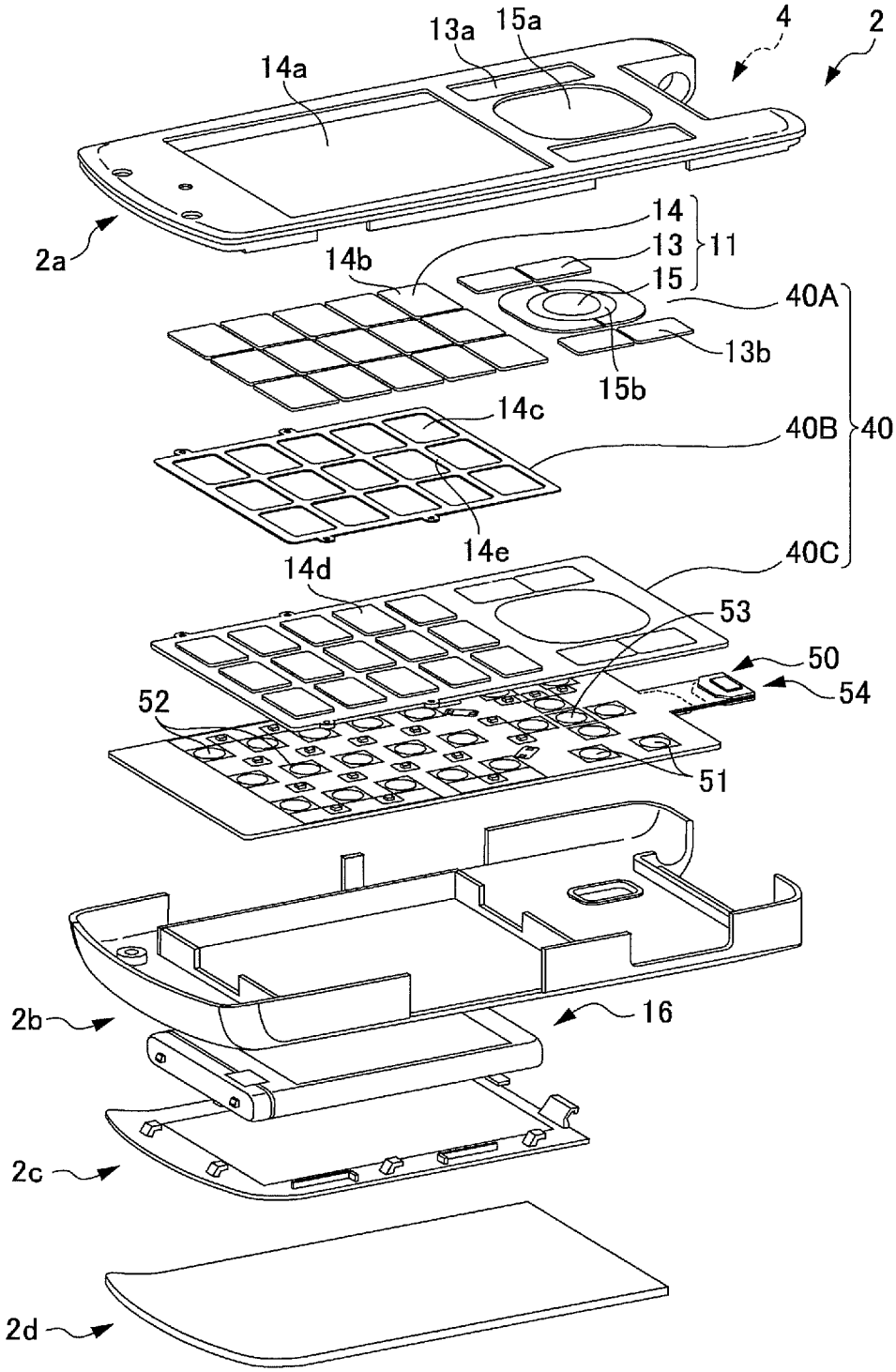
FIG. 2 is an exploded perspective view of the operation-section-side housing.

FIG. 2 is an exploded perspective view of the operation-section-side housing 2.

The operation-section-side housing 2 comprises: a front case 2*a*; a key structure section 40; a key substrate 50; a rear case 2*b* comprising a battery lid 2*c*; a first case member 2*d*; and a battery 16.

The front case 2*a* and the rear case 2*b* are arranged so that their respective concave inner surfaces face each other, and are linked so that their respective peripheral borders overlap. Moreover, on the outer surface of the rear case 2*b*, the first case member 2*d* is connected. This first case member 2*d* is connected to be mobile relative to the rear case 2*b*. Moreover, between the front case 2*a* and the rear case 2*b*, the key structure section 40 and the key substrate 50 that comprises a flexible printed circuit board 54 are sandwiched and built in.

In the front case 2*a*, key holes 13*a*, 14*a*, 15*a* are formed on the inner surface facing the display section 21 of the display-section-side housing 3 when the mobile phone 1 is in the folded state (closed state). The operation surface of a function-setting operation key member 13*b* configuring the function-setting operation key 13, the operation surface of an input operation key member 14*b* configuring the input operation key 14, and the operation surface of a selection operation key member 15*b* configuring the selection operation key 15 are respectively exposed from the key holes 13*a*, 14*a*, 15*a*. By performing an operation to press down the operation surfaces of the exposed function-setting operation key member 13*b*, input operation key member 14*b*, and selection operation key member 15*b*, the top of a metal dome (bowl-shaped) arranged on each of corresponding key switches 51, 52, 53 is pressed and comes into contact with a switch terminal and electric conduction is performed.

The key structure section 40 comprises: an operation member 40A; a key frame 40B; and a key sheet 40C acting as a sheet member.

The operation member 40A comprises multiple key operation members. Specifically, the operation member 40A comprises the function-setting operation key member 13*b*, the input operation key member 14*b*, and the selection operation key member 15*b*. Each of the operation key members configuring the operation member 40A is adhered to the key sheet 40C by sandwiching the key frame 40B. As described above, the respective pressed surfaces of each operation key member adhered to the key sheet 40C is arranged to be exposed externally through the key holes 13*a*, 14*a*, 15*a*, respectively.

The key frame 40B is arranged in a manner corresponding to the operation section 11 (operation member 40A) and supports the operation section 11 (operation member 40A). The key frame 40B is a metallic plate-like member on which multiple hole sections 14*c* are formed. Moreover, the key frame 40B comprises a latticed section at which a conductor is formed at an angle. Furthermore, the key frame 40B also acts as a reinforced member for reducing adverse effects to the circuit board (not shown), etc. caused by operation of the input operation key member 14*b*. Moreover, the key frame 40B is a conductive member, and also functions as a member for releasing static electricity in the input operation key member 14*b*. On the multiple hole sections 14*c* formed on the key frame 40B, a convex section 14*d* formed on the key sheet 40C is arranged in an interlocking manner. Furthermore, the input operation key member 14*b* is adhered to the convex section 14*d*.

The key sheet 40C is, for example, a sheet-like member comprising flexible silicon rubber. On the key sheet 40C, multiple convex sections 14*d* are formed. The multiple convex sections 14*d* are formed on the surface on the side of the key sheet 40C where the key frame 40B is arranged. Each of these multiple convex sections 14*d* are formed at a position corresponding to the key switch 52.

The key substrate 50 comprises the multiple key switches 51, 52, 53 arranged on the surface on the side of the key sheet 40C. Each of the multiple key switches 51, 52, 53 is arranged at a position corresponding to each operation member 40A. The key switches 51, 52, 53 arranged on the key substrate 50 are structures comprising a metal dome comprising a metal sheet formed three-dimensionally by being curved in a bowl-like shape. When the top of the bowl-like shape of the metal dome is pressed, the metal dome comes into contact with a switch terminal formed on an electric circuit (not shown) printed on the surface of the key substrate 50 and conduction with the switch terminal is performed.

In this way, the mobile phone 1 comprises functions for reducing deteriorations in antenna radiation gains when the operation-section-side housing 2 and the display-section-side housing 3 are in a closed state.

The following are descriptions of configurations for realizing the above functions related to the mobile phone 1.

Figure 3A:
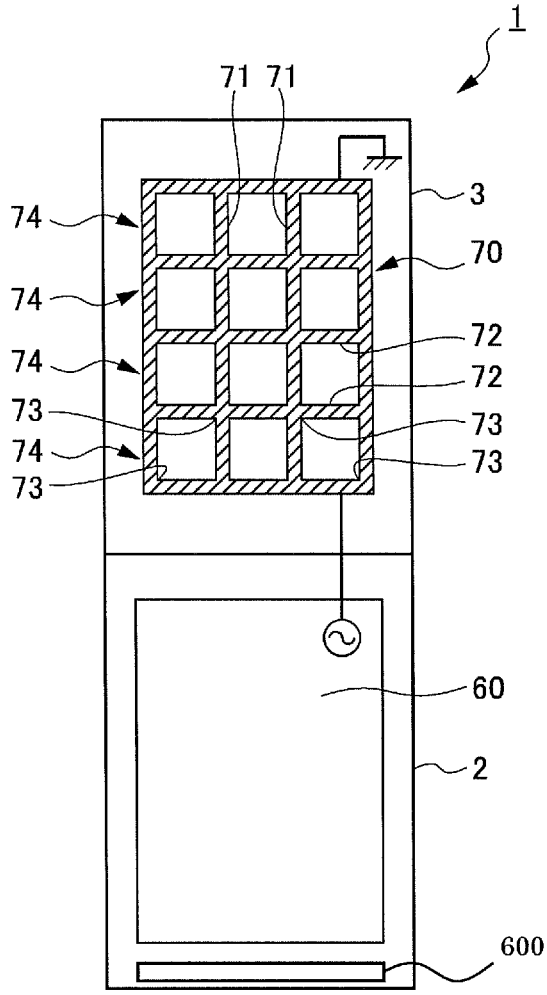
FIGS. 3A-B are pattern diagrams of the mobile phone 1 in an open state.
Figure 3B:
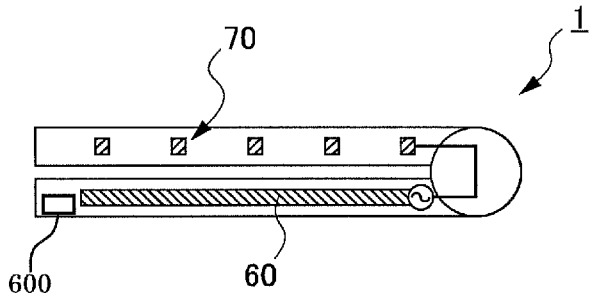

First, a configuration for realizing the above functions of the mobile phone 1 according to the present embodiment will be described with reference to FIG. 3. FIG. 3 is a pattern diagram showing a skeleton framework of the mobile phone 1. Here, FIG. 3A is a pattern diagram of the mobile phone 1 in an open state, and FIG. 3B is a pattern diagram of the mobile phone 1 in a closed state.

In the operation-section-side housing 2, a first antenna 60 that resonates at a prescribed wavelength λ1 is arranged. For example, if the frequency of the radio waves emitted from the first antenna 60 is 800 (MHz) to 900 (MHz), the prescribed wavelength λ1 is 0.375 (m) to 0.333 (m). In the operation-section-side housing 2, a second antenna 600 is arranged.

In the display-section-side housing 3, a first conductive section 70 is arranged. The first conductive section 70 is electrically connected to a reference potential, and is also electrically connected to the first antenna 60. As a result, the first antenna 60 and the first conductive section 70 function as a dipole antenna. The first conductive section 70 comprises: a first section 71 formed at a length corresponding to the prescribed wavelength; and a high-impedance section 73 that is arranged on the end of the first section 71 and has a higher impedance than the first section 71. When the length corresponding to the prescribed wavelength is defined as L, the length L and the prescribed wavelength λ1 establish the relationship shown in the following Formula (1):

$$L=(2n-1)\lambda 1/4 \ (n\text{: natural number}) \quad (1)$$

Moreover, in the present embodiment, the first conductive section 70 comprises a second section 72 that is formed at an angle relative to the first section 71, and the high-impedance section 73 comprises the section where the first section 71 and the second section 72 form an angle.

In other words, the first conductive section 70 is a configuration in which unit cells 74 are arranged in a 4×3 (vertical× horizontal) arrangement. The unit cells 74 comprise a vertical edge section and a horizontal edge section connected at an angle to the vertical edge section. The first section 71 is the vertical edge section of the unit cells 74. The second section 72 is the horizontal edge section that is the section connected at an angle in the unit cells 74. The high-impedance section 73 is the section in the unit cells 74 where the vertical edge section and the horizontal edge section are connected. For this reason, there are 4 high-impedance sections 73 for each unit cell 74.

Although the first conductive section 70 is formed from 12 unit cells 74 in FIG. 3, it is not limited to this configuration as long as it is formed from 1 or more unit cells 74. Moreover, although the first conductive section 70 is an arrangement of 4 unit cells 74 in the vertical direction and 3 unit cells 74 in the horizontal direction in FIG. 3, it is not limited to this configuration and may be an arrangement of an arbitrary number of unit cells 74 arranged in the vertical and horizontal directions.

In the mobile phone 1 of this type of configuration, when radio waves are emitted when the operation-section-side housing 2 and the display-section-side housing 3 are in a closed state, a high-frequency current is fed to the first conductive section 70. In this case, the current propagated through each first section 71 and each second section 72 in the first conductive section 70 is reflected by the high-impedance section 73. As a result, the current propagated through the first section 71 and the second section 72 toward the high-impedance section 73 negates and is negated by the current reflected by the high-impedance section 73, and therefore, the flow of current to the first conductive section 70 is decreased. For this reason, when the mobile phone 1 is in a closed state, negative-phase-sequence current related to the first antenna 60 is decreased.

As described above, in the mobile phone 1, because high-frequency currents are negated by the first conductive section 70 comprising the first section 71 and the high-impedance section 73, it is possible to decrease negative-phase-sequence current when the operation-section-side housing 2 and the display-section-side housing 3 are in a closed state. Consequently, in the mobile phone 1, it becomes difficult for the electric field emitted from the first antenna 60 to be balanced out, and deteriorations of the radiation gains of the antenna are reduced.

FIG. 4 is an explanatory diagram of a first modified example of a first conductive section 80, and is a pattern diagram showing a skeleton framework of the mobile phone 1 equipped with this first conductive section 80.

Figure 4A:
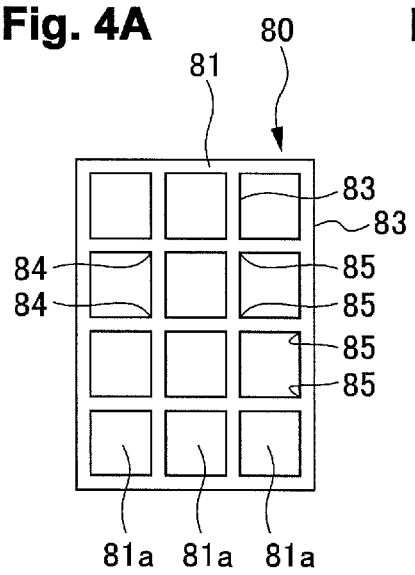
FIGS. 4A-C are explanatory diagrams of a first modified example of mobile phone 1.
Figure 4B:
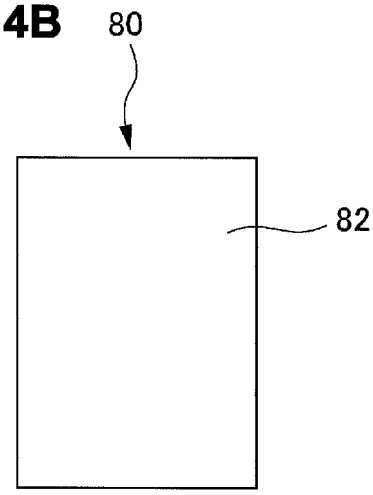
Figure 4C:
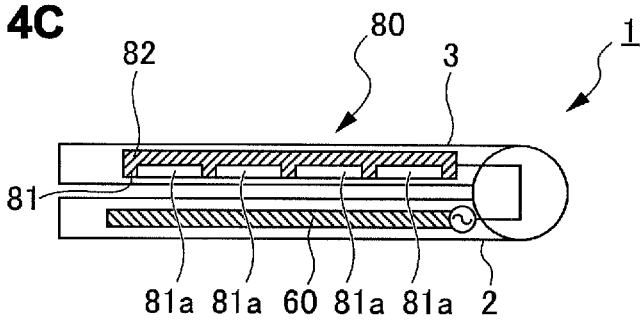

As shown in FIG. 4C, the first conductive section 80 preferably comprises a first section 83 and a high-impedance section 85 on a first surface 81 facing the operation-section-side housing 2 when the operation-section-side housing 2 and the display-section-side housing 3 are in a closed state. In this case, the first conductive section 80 need not comprise the first section 83 and the high-impedance section 85 on a second surface 82 on the other side of the first surface 81. In other words, as shown in FIG. 4A, the first conductive section 80 forms multiple unit-cell patterns by providing concave sections 81*a* on the first surface 81, and at the same time, as shown in FIG. 4B, no concave sections are provided on the second surface 82 and the second surface 82 is formed as a flat surface. The unit-cell patterns arranged on the first surface 81 comprise the first section 83, the second section 84, and the high-impedance section 85 that acts as the section where the first section 83 and the second section 84 meet at an angle.

As with the abovementioned first conductive section 70, when the operation-section-side housing 2 and the display-section-side housing 3 are in a closed state, the mobile phone 1 negates high-frequency current through multiple unit-cell patterns provided on the flat surface 81 of the first conductive section 80. On the other hand, in the mobile phone 1, when the operation-section-side housing 2 and the display-section-side housing 3 are in an open state, because high-frequency current flows toward the second surface 82 of the first conductive section 80, it becomes difficult for the current to be negated by the unit-cell patterns, and it becomes possible for the first conductive section 80 to be used as part of a dipole antenna.

Consequently, in the mobile phone 1, when the operation-section-side housing 2 and the display-section-side housing 3 are in a closed state, because negative-phase-sequence current in the facing regions of the first antenna 60 and the first conductive section 80 is reduced, it becomes difficult for the electric field emitted from the first antenna 60 to be balanced out, and deteriorations of the radiation gains of the antenna are reduced. On the other hand, when the operation-section-side housing 2 and the display-section-side housing 3 are in an open state, high-frequency current flows to the first antenna 60 and the first conductive section 80, and deteriorations of the radiation gains of the antenna functioning as a dipole antenna comprising the first antenna 60 and the first conductive section 80 are reduced.

FIG. 5 is an explanatory diagram of a second modified example of a first conductive section 90, and is a pattern diagram showing a skeleton framework of the mobile phone 1 equipped with the first conductive section 90.

Figure 5A:
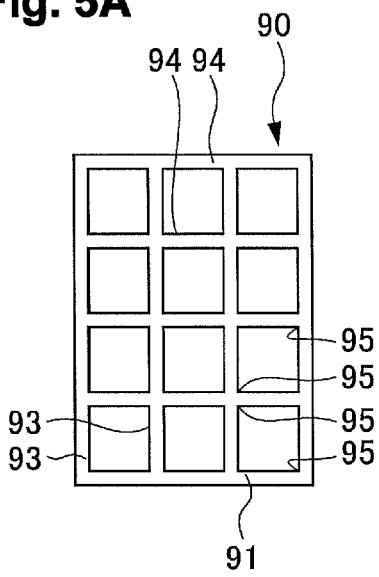
FIGS. 5A-C are explanatory diagrams of a second modified example of mobile phone 1.
Figure 5B:
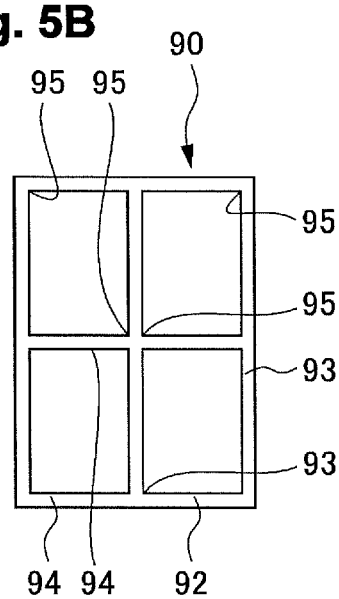
Figure 5C:
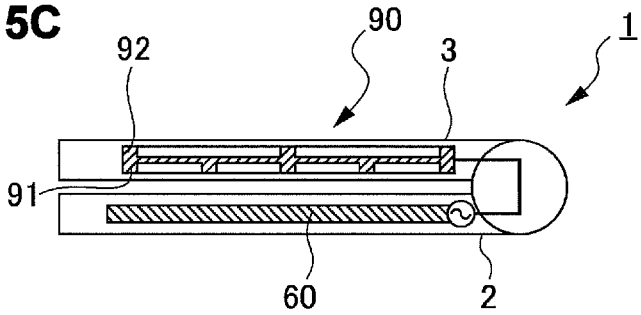

As shown in FIG. 5C, the first conductive section 90 may comprise a first section 93 and a high-impedance section 95 on a first surface 91 as well as a second surface 92 on the other side of the first surface 91. In this case, the respective numbers of the first section 93 and the high-impedance section 95 formed on the first surface 91 are preferably greater than the respective numbers of the first section 93 and the high-impedance section 95 formed on the second surface 92.

In other words, in the first conductive section 90, multiple unit-cell patterns are formed on both the first surface 91 and the second surface 92. As shown in FIG. 5A, the unit-cell patterns formed on the first surface 91 of the first conductive section 90 comprise a pattern of 12 unit cells. At the same time, as shown in FIG. 5B, the unit-cell patterns formed on the second surface 92 of the first conductive section 90 comprise a pattern of 4 unit cells. The unit-cell patterns arranged on each of the first surface 91 and the second surface 92 comprise: the first section 93; the second section 94; and the high-impedance section 95 that acts as the section where the first section 93 and the second section 94 meet at an angle. The number of unit-cell patterns formed on the first surface 91 and the number of unit-cell patterns formed on the second surface 92 are not limited to the example shown in FIG. 5.

As in the abovementioned first conductive section 70, when the operation-section-side housing 2 and the display-section-side housing 3 are in a closed state, the mobile phone 1 negates high-frequency current using the unit-cell patterns arranged on each of the first surface 91 and the second surface 92 of the first conductive section 90. On the other hand, in the mobile phone 1, when the operation-section-side housing 2 and the display-section side housing 3 are in an open state, because high-frequency current flows more toward to the low-impedance second surface 92 compared to the first surface 91, it is possible to use the first conductive section 90 as part of a dipole antenna.

Consequently, in the mobile phone 1, when the operation-section-side housing 2 and the display-section-side housing 3 are in a closed state, because negative-phase-sequence current in the facing regions of the first antenna 60 and the first conductive section 90 is reduced, it becomes difficult for the electric field emitted from the first antenna 60 to be balanced out, and deteriorations of the radiation gains of the antenna are reduced. On the other hand, when the operation-section-side housing 2 and the display-section-side housing 3 are in an open state, high-frequency current flows to the first antenna 60 and the first conductive section 90, and deteriorations of the radiation gains of the antenna functioning as a dipole antenna comprising the first antenna 60 and the first conductive section 90 are reduced.

Figure 6:
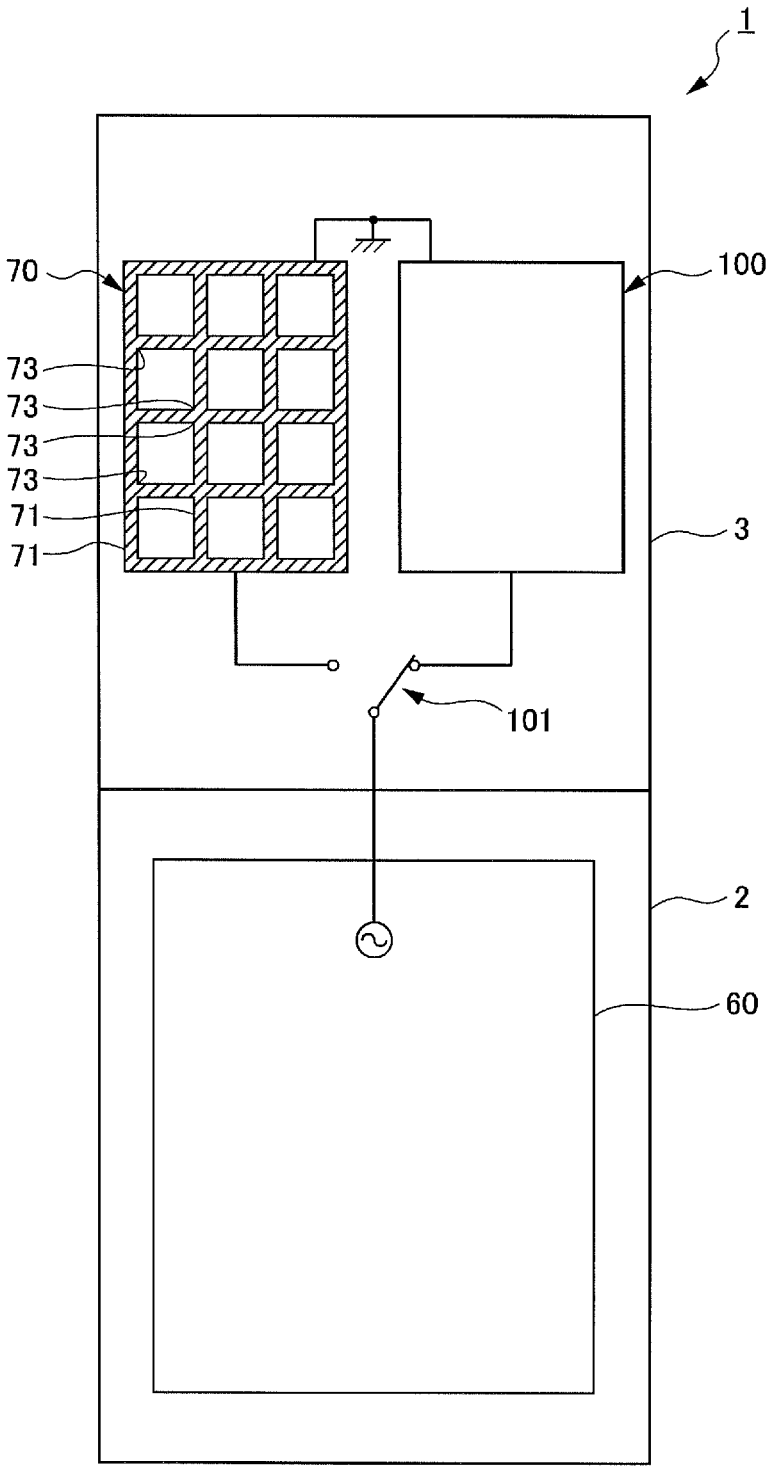
FIG. 6 is a pattern diagram showing a skeleton framework of another modified example of the mobile phone 1.

FIG. 6 is a pattern diagram showing a skeleton framework of another modified example of the mobile phone 1, wherein the first conductive section 70 and the second conductive section 100 are arranged in the display-section-side housing 3.

In the display-section-side housing 3, it is preferable that the second conductive section 100, in which the numbers of the first section 71 and the high-impedance section 73 are lower than the numbers of the first section 71 and the high-impedance section 73 configuring the first conductive section 70, is arranged. The second conductive section 100 is, for example: an insert plate that is insert molded in the display-section-side housing 3; a shield case or evaporated metal arranged inside the display-section-side housing 3; or a conductive case member forming the outer surface of the display-section-side housing 3.

In other words, in the display-section-side housing 3, the first conductive section 70 and the second conductive section 100 are arranged. The first conductive section 70 may be, for example, that shown in FIG. 3A. The second conductive section 100 is a conductor formed from a single or multiple unit cells, or a conductor comprising a flat plate on which no unit cells are formed. If the second conductive section 100 is formed from a single or multiple unit cells, the number of unit cells of the second conductive section 100 is lower than the number of the unit cells 74 of the first conductive section 70. Furthermore, in the case shown in FIG. 6, the second conductive section 100 is a flat plate conductor on which no unit cells are formed.

These types of the first conductive section 70 and the second conductive section 100 are connected via a switch section (selection section) 101. The switch section 101 is electrically connected to the first antenna 60 arranged in the operation-section-side housing 2. Due to control by a control section that is not shown, when the operation-section-side housing 2 and the display-section-side housing 3 are in a closed state, the switch section 101 electrically (at a high frequency) connects the first antenna 60 and the first conductive section 70, and when the operation-section-side housing 2 and the display-section-side housing 3 are in an open state, it electrically (at a high frequency) connects the first antenna 60 and the second conductive section 100.

When the operation-section-side housing 2 and the display-section-side housing 3 are in a closed state, the mobile phone 1 negates high-frequency current using the first conductive section 70. On the other hand, in the mobile phone 1, when the operation-section-side housing 2 and the display-section-side housing 3 are in an open state, because high-frequency current flows to the second conductive section 100, it is possible to use the second conductive section 100 as part of a dipole antenna.

Consequently, in the mobile phone 1, when the operation-section-side housing 2 and the display-section-side housing 3 are in a closed state, because negative-phase-sequence current in the facing regions of the first antenna 60 and the first conductive section 70 are reduced, it becomes difficult for the electric field emitted from the first antenna 60 to be balanced out, and deteriorations of the radiation gains of the antenna are reduced. On the other hand, when the operation-section-side housing 2 and the display-section-side housing 3 are in an open state, because high-frequency current flows to the first antenna 60 and the second conductive section 100, deteriorations of the radiation gains of the antenna functioning as a dipole antenna comprising the first antenna 60 and the second conductive section 100 are reduced.

Moreover, the first conductive section 70 may also be configured by the key frame 40B (refer to FIG. 2) arranged in the operation-section-side housing 2. In this case, the first antenna 60 is arranged in the display-section-side housing 3. If the first conductive section 70 is the key frame 40B, the first section 71 is configured by the conductors of the latticed section, and the high-impedance section 73 is the section where the conductors of the latticed section form an angle. In other words, the high-impedance section 73 is the section where the conductors configuring the latticed section intersect. Furthermore, if the first section 71 is the key frame 40B, the key frame 40B is electrically connected to the reference potential.

Consequently, if the first conductive section 70 is the key frame 40B, the mobile phone 1 can reduce negative-phase-sequence current in the existing parts (key frame 40B) without adding new parts to act as the first conductive section 70. As a result, the mobile phone 1 can reduce the incidence of the operation-section-side housing 2 becoming thicker in order to additionally configure the first conductive section 70 as a new part, and can reduce cost increases caused by large numbers of parts.

Furthermore, the first conductive section 70 is preferably connected to a reference potential via an inductor or beads. By connecting the first conductive section 70 to a reference potential via an inductor or beads, it becomes possible to increase the attenuation of the negative-phase-sequence current or freely control the frequency being attenuated.

When the operation-section-side housing 2 and the display-section-side housing 3 are in a closed state, if the length of the first section 71 comprising the first conductive section 70 and the prescribed wavelength $\lambda 1$ establish the relationship shown in Formula (1), it becomes possible to reduce negative-phase-sequence current. In addition, there are cases in which a second antenna 600 used for the global positioning system (GPS) or for Bluetooth communication is arranged in the mobile phone 1. If the second antenna 600 is used as a monopole antenna, when the operation-section-side housing 2 and the display-section-side housing 3 are in a closed state, in order to reduce the incidence of the first conductive section 70 blocking the electric field emitted from the second antenna 600 arranged in the operation-section-side housing 2, it is necessary to cause the second antenna 600 to resonate at a specific wavelength $\lambda 2$. In other words, the wavelength $\lambda 2$ and the length L of the first section 71 must establish the relationship shown in the following Formula (2):

$$L=(2m-1)\lambda 2/4 \text{ (}m\text{: natural number)} \quad (2)$$

Because L is a value determined according to the relationship with the prescribed wavelength $\lambda 1$, the wavelength $\lambda 2$ is determined based on Formula (2).

Here, when Formulae (1) and (2) are arranged by removing L, the wavelength $\lambda 2$ and the prescribed wavelength $\lambda 1$ establish the relationship shown in the following Formula (3):

$$\lambda 2=(2n-1)\lambda 1/(2m-1) \text{ (}n,m\text{: natural numbers)} \quad (3)$$

In the mobile phone 1, if the first antenna 60 resonates at the prescribed wavelength λ1, by arranging the second antenna 600 that resonates at the wavelength λ2 obtained from Formula (3) in the operation-section-side housing 2, it becomes possible to negate high-frequency current using the first conductive section 70 even when the operation-section-side housing 2 and the display-section-side housing 3 are in a closed state, and furthermore, it becomes possible to reduce the incidence of the first conductive section 70 blocking the electric field emitted from the second antenna 600.

Consequently, the mobile phone 1 can reduce deteriorations in antenna radiation gains.

Furthermore, the present invention is not limited to the above embodiments, and may be implemented in various modes.

Figure 7A:
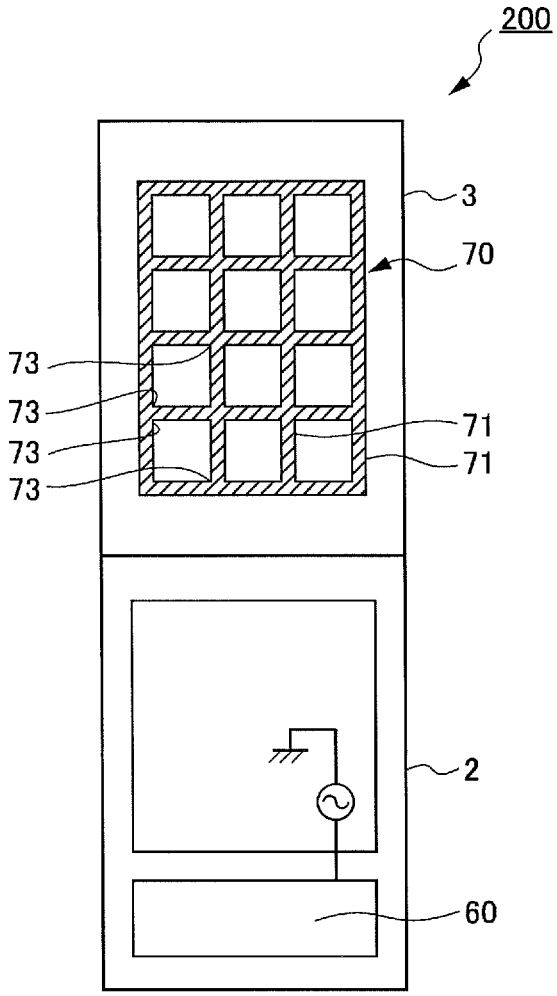
FIG. 7A-B is a pattern diagram showing a skeleton framework of a mobile phone 200.
Figure 7B:
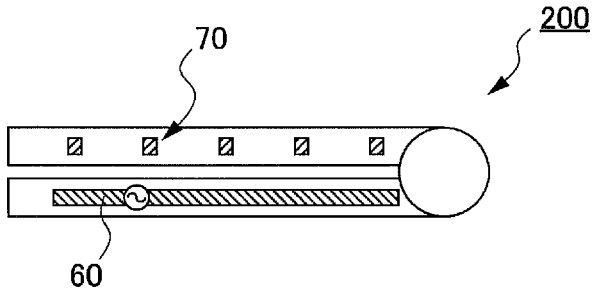

In the above embodiments, cases were described in which a dipole antenna was configured by the first antenna 60 and the first conductive sections 70, 80, 90 (first conductive section 70). However, the present invention is not limited to this configuration, and as shown in FIG. 7, the first antenna 60 may configure a monopole antenna. Here, FIG. 7 is a pattern diagram showing a skeleton framework of a mobile phone 200 in which a monopole antenna (first antenna 60) is arranged. In this case, the first conductive section 70 comprises the first section 71 and the high-impedance section 73 (comprises a single or multiple unit cells). As a result, in the mobile phone 200, even if the operation-section-side housing 2 and the display-section-side housing 3 are in a closed state, it becomes difficult for the electric field emitted from the first antenna 60 to be blocked by the first conductive section 70, and as a result, deteriorations of the radiation gains of the antenna are reduced.

Moreover, as with the abovementioned dipole antenna, even if the first antenna 60 is a monopole antenna, the mobile phone 200 may comprise the second conductive section 100. This allows the mobile phone 200 to obtain the same actions and effects as a mobile phone that comprises a dipole antenna and further comprises the second conductive section 100.

Moreover, as shown above, the first antenna 60 has been described based on cases in which a dipole antenna or a monopole antenna is configured. However, the first antenna may be another type of antenna, such as, for example, an inverted-F antenna or a loop antenna.

Figure 8A:
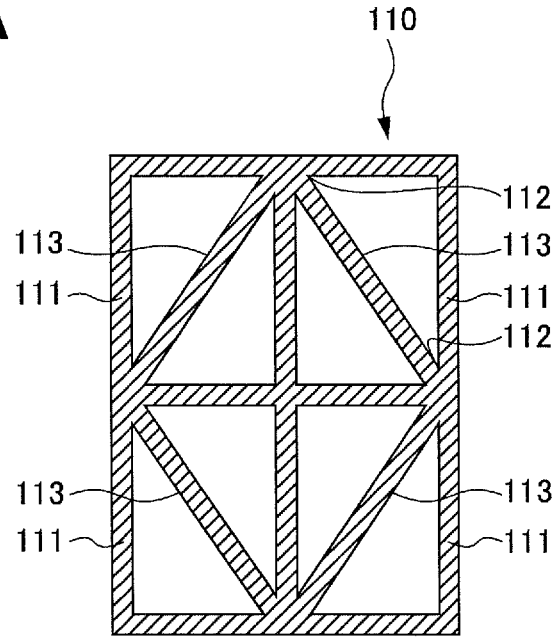
FIG. 8A-B is an explanatory diagram of a modified example of the first conductive section.
Figure 8B:
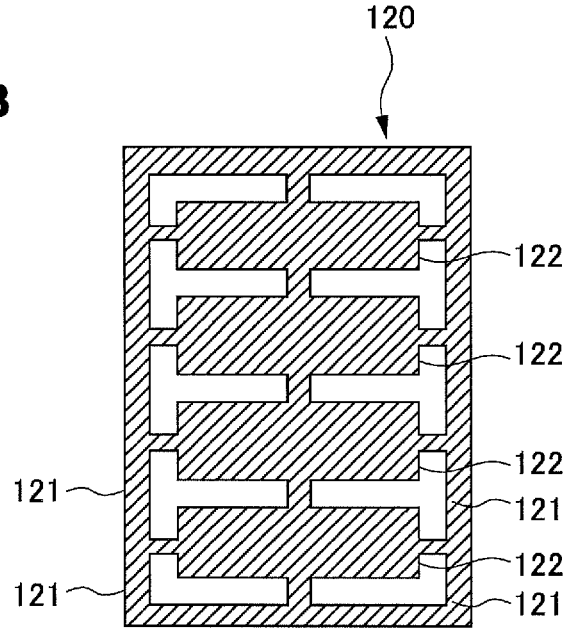

FIG. 8 is an explanatory diagram of a modified example of the first conductive section. In the above embodiments, configurations of the first conductive section comprising a single or multiple unit cells have been described. However, as shown in FIG. 8A, the first conductive section 110 may be a configuration comprising a conductor 113 extended in a diagonal direction from the corner (high-impedance section 112) of a unit cell 111. Moreover, as shown in FIG. 8B, the first conductive section 120 may be a configuration that comprises multiple unit cells 121 and in which an island section 122 is provided in the section where 4 unit cells 121 overlap. Furthermore, electronic parts can also be mounted on the island section 122.

If the conductor 113 and the island section 122 establish the relationship shown in the above Formula (1), when the operation-section-side housing 2 and the display-section-side housing 3 are in a closed state, because negative-phase-sequence current in the facing regions of the first antenna 60 and the first conductive section is reduced, it becomes difficult for the electric field emitted from the first antenna 60 to be balanced out, and deteriorations of the radiation gains of the antenna are reduced. On the other hand, when the operation-section-side housing 2 and the display-section-side housing 3 are in an open state, high-frequency current flows to the first antenna 60 and the first conductive section, and deteriorations of the radiation gains of the antenna functioning as a dipole antenna comprising the first antenna 60 and the first conductive section are reduced.

Moreover, in the above embodiments, cases were described in which the first antenna 60 is arranged in the operation-section-side housing 2, and the first conductive sections 70, 80, 90 are arranged in the display-section-side housing 3. However, the present invention may have a configuration in which the first antenna is arranged in the display-section-side housing and the first conductive section is arranged in the operation-section-side housing.

Moreover, in the above embodiments, examples were described in which the present invention is applied to the mobile phone 1. However, the present invention can also be applied to mobile terminals such as, for example, a PHS (Personal Handyphone System).

While at least one exemplary embodiment is presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being comprised within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the present disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section;

a connection section that connects the first housing and the second housing so as to transit between an open state, in which the first housing and the second housing are open, and a closed state, in which the first housing and the second housing are closed;

wherein when the prescribed wavelength is defined as $\lambda 1$ and the length corresponding to the prescribed wavelength is defined as L, the following relationship is established: $L=(2n-1)\lambda 1/4$ (n: natural number).

2. The mobile terminal according to claim 1, wherein the first conductive section is connected to a reference potential via an inductor or beads.

3. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section; wherein the first conductive section is on a first surface that faces the first housing when the first housing and the second housing are in the closed state;

a connection section that connects the first housing and the second housing so as to transit between an open state, in which the first housing and the second housing are open, and a closed state, in which the first housing and the second housing are closed;

wherein the first conductive section comprises the first section and the high-impedance section on the first surface and a second surface on an opposite side from the first surface, and wherein respective numbers of the first section and the high-impedance section formed on the first surface are greater than respective numbers of the first section and the high-impedance section formed on the second surface.

4. The mobile terminal according to claim 3, wherein in the open state, a dipole antenna is formed by the first antenna and the side of the second surface of the first conductive section.

5. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section; wherein the first conductive section is on a first surface that faces the first housing when the first housing and the second housing are in the closed state;

a connection section that connects the first housing and the second housing so as to transit between an open state, in which the first housing and the second housing are open, and a closed state, in which the first housing and the second housing are closed;

wherein the first conductive section does not comprise the first section and the high-impedance section on a second surface on the opposite side of the first surface.

6. The mobile terminal according to claim 5, wherein in the open state, a dipole antenna is formed by the first antenna and the side of the second surface of the first conductive section.

7. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section;

a connection section that connects the first housing and the second housing so as to transit between an open state, in which the first housing and the second housing are open, and a closed state, in which the first housing and the second housing are closed;

wherein the following are arranged in the second housing: a second conductive section in which numbers of the first section and the high-impedance section are less than numbers of the first section and the high-impedance section in the first conductive section; and a selection section that connects the first antenna and the first conductive section at a high frequency when the first housing and the second housing are in the closed state, and connects the first antenna and the second conductive section at a high frequency when the first housing and the second housing are in the open state.

8. The mobile terminal according to claim 7, wherein the second conductive section does not comprise the first section and the high-impedance section.

9. The mobile terminal according to claim 7, wherein in the open state, a dipole antenna is formed by the first antenna and the second conductive section.

10. The mobile terminal according to claim 7, wherein the second conductive section is an insert plate that is insert molded in the second housing.

11. The mobile terminal according to claim 7, wherein the second conductive section is a shield case arranged in the second housing.

12. The mobile terminal according to claim 7, wherein the second conductive section is an evaporated metal arranged in the second housing.

13. The mobile terminal according to claim 7, wherein the second conductive section is a conductive case member forming the external appearance of the second housing.

14. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section;

a connection section that connects the first housing and the second housing so as to transit between an open state, in which the first housing and the second housing are open, and a closed state, in which the first housing and the second housing are closed;

wherein the first conductive section comprises a second section formed at an angle relative to the first section, and the high-impedance section is the section where the first section and the second section form an angle.

15. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section;

a connection section that connects the first housing and the second housing so as to transit between an open state, in which the first housing and the second housing are open, and a closed state, in which the first housing and the second housing are closed;

an operation section; and a key frame arranged corresponding to the operation section, wherein the key frame comprises a latticed section where a conductor is formed at an angle, and the first section is configured by the conductor of the latticed section, and the high-impedance section is the section where the conductor of the latticed section forms an angle.

16. A mobile terminal comprising:

a first housing in which a first antenna that resonates at a prescribed wavelength is arranged;

a second housing in which a first conductive section is arranged, wherein the first conductive section comprises: a first section having a length corresponding to the prescribed wavelength; and a high-impedance section that is arranged on an end of the first section and has a higher impedance than the first section;

a connection section that connects the first housing and the second housing so as to transit between an open state, in which the first housing and the second housing are open, and a closed state, in which the first housing and the second housing are closed;

wherein a second antenna that resonates at a wavelength $\lambda 2$ is arranged in the first housing, and when the prescribed wavelength is defined as $\lambda 1$, the wavelength $\lambda 2$ meets the following relationship: $\lambda 2=(2n-1)\lambda 1/(2m-1)$ (n, m: natural numbers).

* * * * *